US010065762B2

(12) United States Patent
Schultz et al.

(10) Patent No.: US 10,065,762 B2
(45) Date of Patent: Sep. 4, 2018

(54) DISPENSER HAVING A TOWER PORTION AND AN INSERT PORTION

(71) Applicant: TIDI Products, LLC, Neenah, WI (US)

(72) Inventors: Bradly Thomas Schultz, Greenville, WI (US); Brian Wilt, Appleton, WI (US); Katie Umentum, DePere, WI (US); Rob Sweitzer, Apex, NC (US)

(73) Assignee: TIDI Products, LLC, Neenah, WI (US)

( * ) Notice: Subject to any disclaimer, the term of this patent is extended or adjusted under 35 U.S.C. 154(b) by 0 days.

(21) Appl. No.: 14/264,206

(22) Filed: Apr. 29, 2014

(65) Prior Publication Data

US 2014/0319205 A1 Oct. 30, 2014

Related U.S. Application Data

(60) Provisional application No. 61/817,403, filed on Apr. 30, 2013.

(51) Int. Cl.

| | |
|---|---|
| ***B65D 5/72*** | (2006.01) |
| ***B65D 5/02*** | (2006.01) |
| ***B65D 5/42*** | (2006.01) |

(52) U.S. Cl.

CPC ..... *B65D 5/725* (2013.01); *B65D 5/029* (2013.01); *B65D 5/0245* (2013.01); *B65D 5/0254* (2013.01); *B65D 5/4204* (2013.01)

(58) Field of Classification Search

CPC ..... B65D 5/725; B65D 71/36

USPC ..... 229/122.1; 221/302, 305, 312 R, 312 C

See application file for complete search history.

(56) References Cited

U.S. PATENT DOCUMENTS

| | | | | | |
|---|---|---|---|---|---|
| 3,207,380 | A | * | 9/1965 | Hennessey | B65D 5/744 222/183 |
| 3,265,283 | A | * | 8/1966 | Farquhar | 229/221 |
| 3,352,425 | A | | 11/1967 | Burke | |
| 3,836,007 | A | | 9/1974 | Rosenwein | |
| 4,269,315 | A | | 5/1981 | Boyce | |
| 4,752,029 | A | * | 6/1988 | Buford | 229/122.1 |
| 4,767,022 | A | | 8/1988 | Oldorf | |
| 4,805,765 | A | * | 2/1989 | Barrett | B65D 5/724 206/738 |
| 4,899,929 | A | * | 2/1990 | Grollman | B65D 5/36 221/302 |
| 5,249,737 | A | * | 10/1993 | Fritz et al. | 229/122.1 |
| 5,370,220 | A | | 12/1994 | Wang | |
| 5,615,767 | A | | 4/1997 | Eull et al. | |
| 5,642,837 | A | | 7/1997 | Hayes et al. | |

(Continued)

*Primary Examiner* — Christopher DeMeree
*Assistant Examiner* — Phillip Schmidt
(74) *Attorney, Agent, or Firm* — Boyle Fredrickson S.C.

(57) ABSTRACT

The present invention provides a gravity fed dispenser. The gravity fed dispenser includes a tower portion including a front wall, a back wall, a top wall, a bottom wall, and a pair of side walls, and an insert portion located within the tower portion, the insert portion including a front wall, and a pair side of walls attached to opposite edges of the front wall. The dispenser also includes an opening in a lower portion of the tower portion, and at least one tab located in the opening. The tower portion and insert portion are preferably made from a single blank of material. In another embodiment, the insert portion includes a front wall, and a first wing and a second wing attached to opposite edges of the front wall.

26 Claims, 6 Drawing Sheets

(56) References Cited

U.S. PATENT DOCUMENTS

| | | | | |
|---|---|---|---|---|
| 5,794,782 | A | 8/1998 | Ascik | |
| 5,836,478 | A * | 11/1998 | Weiss | 221/309 |
| 6,253,930 | B1 * | 7/2001 | Freidus et al. | 211/59.2 |
| 6,708,841 | B2 | 3/2004 | Baughman | |
| 6,929,133 | B1 | 8/2005 | Knapp, III et al. | |
| 7,648,048 | B2 * | 1/2010 | Smith | 221/305 |
| 7,658,317 | B2 * | 2/2010 | Wilkins | B65D 5/725 206/427 |
| 7,922,035 | B2 | 4/2011 | Long et al. | |
| 8,136,697 | B2 * | 3/2012 | Hackney | 221/305 |
| 8,485,423 | B2 * | 7/2013 | Thomas et al. | 229/200 |
| 2002/0036156 | A1 | 3/2002 | Knaack et al. | |
| 2002/0175177 | A1 * | 11/2002 | Jepson | A47F 1/08 221/131 |
| 2004/0056043 | A1 | 3/2004 | Griesbach, III et al. | |
| 2005/0199690 | A1 | 9/2005 | Peterson | |
| 2007/0152028 | A1 * | 7/2007 | McGowan | 229/122.1 |
| 2007/0262086 | A1 | 11/2007 | Cook et al. | |
| 2009/0188015 | A1 | 7/2009 | Grad et al. | |
| 2011/0079532 | A1 | 4/2011 | Eck | |
| 2012/0012502 | A1 | 1/2012 | Young | |
| 2012/0272437 | A1 | 11/2012 | Grad et al. | |
| 2014/0076918 | A1 | 3/2014 | Hailey et al. | |
| 2014/0319205 | A1 | 10/2014 | Schultz | |
| 2015/0203282 | A1 | 7/2015 | Umentum et al. | |

* cited by examiner

DISPENSER HAVING A TOWER PORTION AND AN INSERT PORTION

CROSS-REFERENCE TO RELATED APPLICATIONS

The present Application claims the benefit of U.S. Provisional Application No. 61/817,403, filed Apr. 30, 2013, the contents of which are incorporated herein by reference.

FEDERALLY SPONSORED RESEARCH OR DEVELOPMENT

N/A

TECHNICAL FIELD

The present invention generally relates to gravity fed dispenser for eye shields or eye shield frames. The eye shields can be used in connection with medical, dental, or other applications.

BACKGROUND OF THE INVENTION

Healthcare professionals often use disposable eye shields to prevent splatter of bodily fluids such as spittle and blood from entering the eyes to prevent potential infections. Healthcare professionals need to be able to have quick and ready access to such eye shields. The present invention provides storage and access to eye shields.

SUMMARY OF THE INVENTION

The present invention provides a unique gravity fed dispenser tower for eye shields or frames that is easily constructed. The tower includes two portions, each made from a single blank of material, such as cardboard or plastic. The gravity fed dispenser includes a tower portion including a front wall, a back wall, a top wall, a bottom wall, and a pair of side walls, and a generally trapezoidal-shaped insert portion located within the tower portion, the insert portion including a front wall, and a pair side of walls attached to opposite edges of the front wall. The dispenser also includes an opening in a lower portion of the tower portion, and at least one tab located in the opening.

In another embodiment, the gravity fed dispenser includes a lower portion including a front wall, a back wall, a top wall, a bottom wall, and a pair of side walls. The dispenser also includes an insert portion located within the tower portion. The insert portion includes a front wall, and a first wing and a second wing attached to opposite edges of the front wall. The dispenser has an opening in a lower portion of the tower portion. The tower portion and insert portion are each formed from a single blank of material.

BRIEF DESCRIPTION OF THE DRAWINGS

To understand the present invention, it will now be described by way of example, with reference to the accompanying drawings in which.

DETAILED DESCRIPTION

Figure 1:
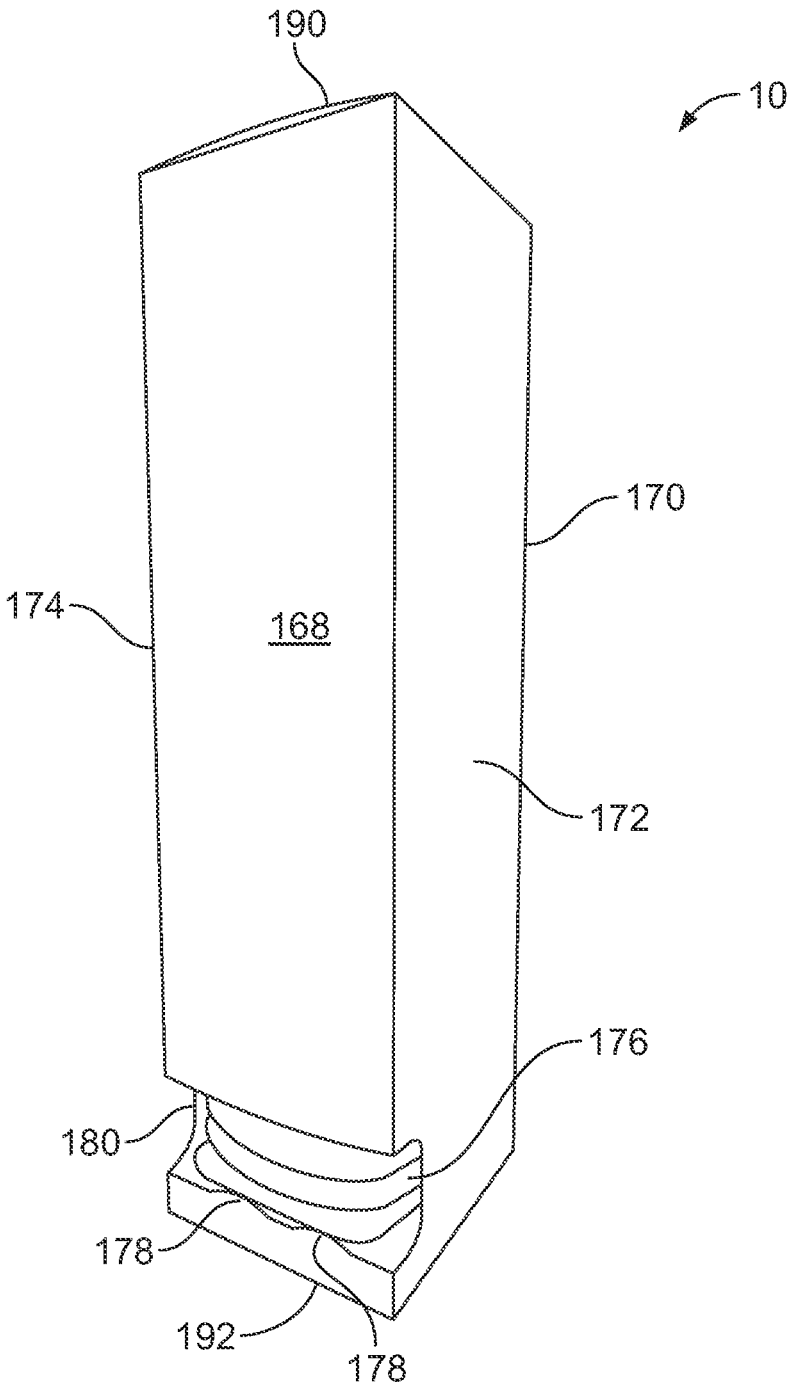
FIG. 1 is a perspective view of a gravity fed eye shield lens tower dispenser made in accord with an embodiment of the present invention.
Figure 2:
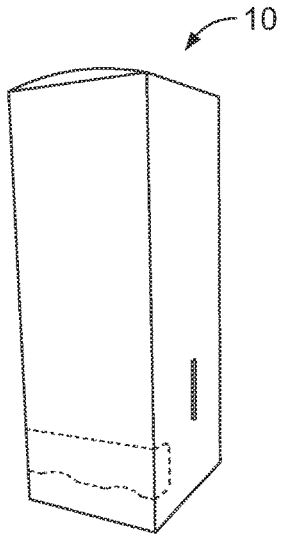
FIG. 2 is a perspective view of the tower portion of the tower dispenser of FIG. 1.
Figure 3:
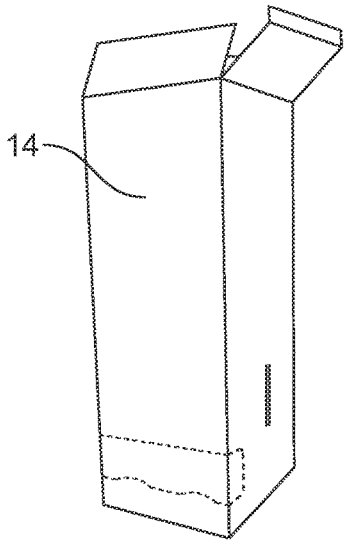
FIG. 3 is a perspective view of the tower portion of the tower dispenser of FIG. 1 wherein the top of the tower is opened.
Figure 4:
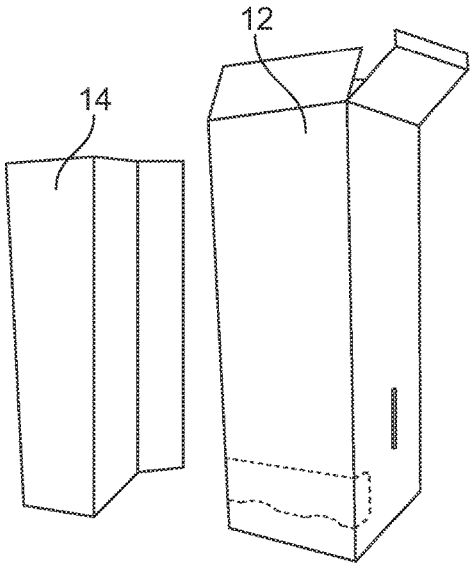
FIG. 4 is a perspective view of the tower portion and insert portion of the tower dispenser of FIG. 1.
Figure 5:
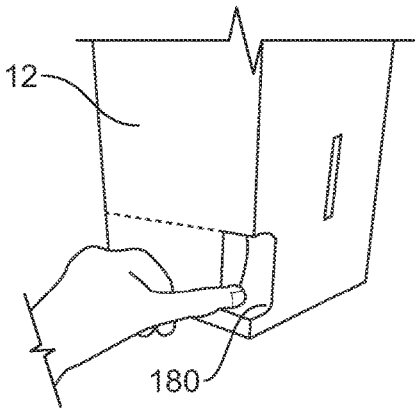
FIG. 5 is a perspective view of the tower dispenser of FIG. 1 wherein the insert portion has been inserted into the tower portion.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the FIGS., a gravity fed eye shield tower dispenser 10 is shown. The dispenser 10 includes a tower portion 12 and an insert 14. The insert 14 is placed inside the tower portion 12 to construct the dispenser as described below. The dispenser 10 is preferably made of a cardboard material, but may be made of any suitable material such as plastic.

Figure 6:
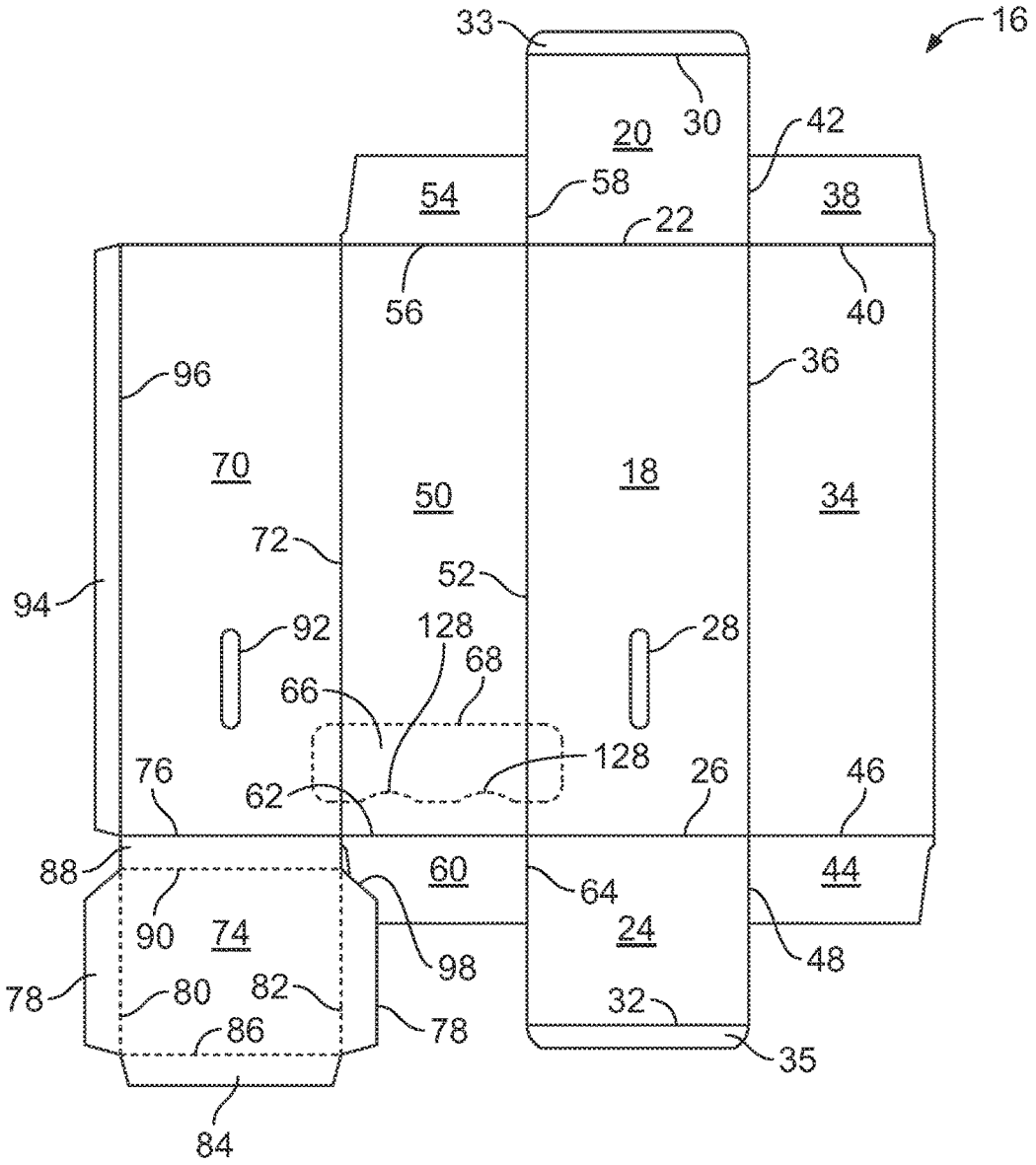
FIG. 6 is a plan view of blank for a tower portion made in accord with an embodiment of the present invention.

The tower portion 12 and insert 14 are preferably made from a single blank of material. FIG. 6 shows a tower portion blank 16 in accord with an embodiment of the present invention. The blank 16 has a first side panel 18. A top lid panel 20 is attached to a top edge of the first side panel 18 along a first fold line 22. A bottom lid panel 24 is attached to a bottom edge of the first side panel 18 along a second fold line 26. The first side panel 18 includes a first generally oval opening 28 towards its bottom edge. The top lid panel 20 includes a third fold line 30 near its free edge. The bottom lid panel 24 includes a fourth fold line 32 near its free edge.

A back panel 34 is attached to an edge of the first side panel 18 along fifth fold line 36. A top back flap 38 is attached to a top edge of the back panel 34 along a sixth fold line 40. The top back flap 38 and top lid panel 20 are detachably attached along a first cut line 42. A bottom back flap 44 is attached to a bottom edge of the back panel 34 along a seventh fold line 46. The bottom back flap 44 and bottom lid panel 24 are detachably attached along a second cut line 48.

A front panel 50 is attached at the opposite edge of the first side panel 18 along an eighth fold line 52. A top front flap 54 is attached to a top edge of the front panel 50 along a ninth fold line 56. The top front flap 54 and top lid panel 20 are detachably attached along a third cut line 58. A bottom front flap 60 is attached to a bottom edge of the front panel 50 along a tenth fold line 62. The bottom front flap 60 and bottom lid panel 24 are detachably attached along a fourth cut line 64. A detachable cutout 66 is located toward the bottom edge of the front panel 50. The cutout is defined by perforated line 68. The cutout 66 extends partially into the first side panel 18 and a second side panel 70.

Figure 10:
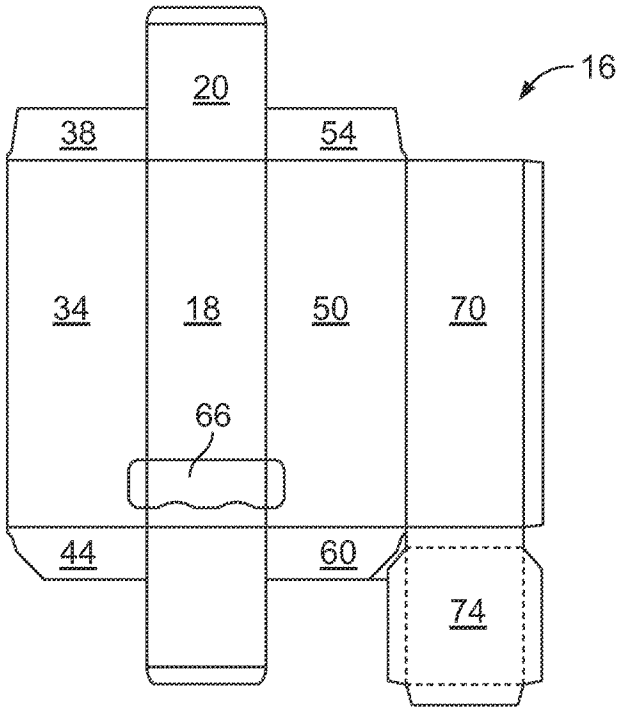
FIG. 10 is a plan view of blank for a tower portion made in accord with an embodiment of the present invention.

The second side panel 70 is attached to an edge of the front panel 50 along an eleventh fold line 72. A bottom platform panel 74 is attached to a bottom edge of the second side panel 70 along a twelfth fold line 76. The bottom platform panel 74 includes side flaps 78 attached along thirteenth and fourteenth fold lines 80 and 82, and a front flap 84 attached along a fifteenth fold line 86. The bottom platform panel 74 also includes an attachment panel 88 formed between the twelfth fold line 76 and sixteenth fold line 90. The second side panel 70 includes a second generally oval opening 92 towards its bottom edge. A glue panel 94 is attached to an edge of the second side panel 70 along a seventeenth fold line 96. The bottom platform panel 74, bottom front flap 60, and one of the side flaps 78 are detachably attached along a fifth cut line 98. FIG. 10 shows an embodiment of the tower portion blank similar to the embodiment of FIG. 6, wherein the dimensions of the panels differ. In addition, the cutout 66 in FIG. 10 is located in the first side panel 18.

Figure 7:
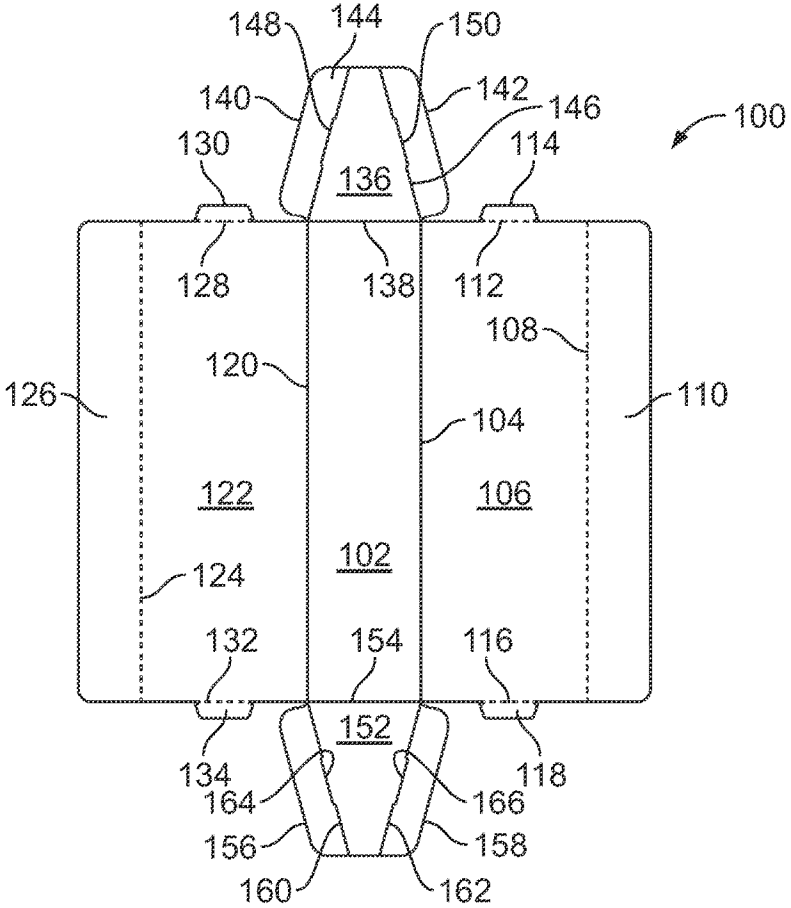
FIG. 7 is a plan view of blank for an insert portion made in accord with an embodiment of the present invention.

FIG. 7 shows an insert blank 100 in accord with an embodiment of the present invention. The blank 100 includes a front panel 102. Attached to a first side edge of the front panel 102 along a first fold line 104 is a first side panel 106. Attached to a side edge of the first side panel 106 along a second fold line 108 is a first wing panel 110. Attached to a top edge of the first side panel 106 along a third fold line 112 is first top tab 114. Attached to a bottom edge of the first side panel 106 along a fourth fold line 116 is first bottom tab 118.

Attached to a second side edge of the front panel 102 along a fifth fold line 120 is a second side panel 122. Attached to a side edge of the second side panel 122 along a sixth fold line 124 is a second wing panel 126. Attached to a top edge of the second side panel 122 along a seventh fold line 128 is second top tab 130. Attached to a bottom edge of the second side panel 122 along an eighth fold line 132 is second bottom tab 134.

A top end panel 136 is attached to a top edge of the front panel 102 along a ninth fold line 138. The top end panel 136 is preferably trapezoidal shaped and tapered inward from the top edge of the front panel 102. The top edge panel 136 includes wings 140 and 142 attached thereto along fold lines 144 and 146. Fold lines 144 and 146 include slots 148 and 150, respectively, along their length.

A bottom end panel 152 is attached to a bottom edge of the front panel 102 along a tenth fold line 154. The bottom end panel 152 is preferably trapezoidal shaped and tapered inward from the bottom edge of the front panel 102. The bottom end panel 152 includes wings 156 and 158 attached thereto along fold lines 160 and 162. Fold lines 160 and 162 include slots 164 and 166, respectively, along their length.

To construct tower dispenser 10, tower blank 16 and insert blank 100 are separately erected. To erect the tower portion 12 from tower blank 16, top back flap 38 and top front flap 54 are separated from the top lid panel 20 along cut lines 42 and 58. Bottom back flap 44 is separated from the bottom lid panel 24 along cut line 48. Bottom front flap 60 is separated from bottom lid panel 24 along cut line 64 and from side flap 78 and bottom platform panel 74.

The back panel 34, first side panel 18, front panel 50 and second side panel 70 are folded inwards along fold lines 36, 52, and 72. Glue is applied to glue panel 94, which is attached to the inner surface of the back panel 34, thus forming a front wall 168, back wall 170, and first and second side walls 172 and 174.

Bottom platform panel 74 is folded inward along fold line 76. Fold lines 80, 82, 86 and 90 are folded such that the bottom platform panel 74 is raised to the level the height of the attachment panel 88. Flaps 78 and 84 and attachment panel 88 are glued to the inner surfaces of the front panel 50, first and second side panels 18 and 70, and back panel 34. Bottom front flap 60 and bottom back flap 44 are folded inward over the bottom platform panel 74 and bottom lid panel 24 is folded over the bottom front and back flaps 60 and 64. Bottom lid panel 24 is folded along fold line 32 and the resulting flap 33 is tucked in to secure the bottom lid panel 24 to create a bottom wall 192.

Inserted blank 100 is erected by folding the first and second side panels 106 and 122 inward along fold lines 104 and 120, respectively. First and second wing panels 110 and 126 are folded outward along fold lines 108 and 124, respectively. Top end panel 136 and bottom end panel 152 are folded inward along fold lines 138 and 154. Wings 140 and 142 of the top end panel 136 are folded inward along fold lines 144 and 146. First and second top tabs 114 and 130 are folded inward along fold lines 112 and 128. First top tab 114 is inserted into slot 150. Second top tab 128 is inserted into slot 148.

Likewise, wings 156 and 158 of the bottom end panel 152 are folded inward along fold lines 160 and 162. First and second bottom tabs 118 and 134 are folded inward along fold lines 116 and 132. First bottom tab 118 is inserted into slot 166. Second bottom tab 134 is inserted into slot 164.

The assembled insert blank 100 is then inserted into the tower portion 12 such that the front panel 102 of the insert blank 100 and the front panel 50 of the tower portion blank 16 are aligned. The first and second wing panels 110 and 126 fold outward and abut the first and second side panels 24 and 50 of the tower panel 16. The detachable cutout 66 is removed along perforation 68 leaving an opening 180 with a pair of tabs 178.

Eye shields 176 are placed and stacked inside the tower portion 12 through the upper end of the tower portion 12 such that the lens portion of the eye shields align between the front panel 50 of the tower portion 12 and the front panel 102 of the insert portion 14, while the earpieces ride along then the side panels 106 and 122 of the insert portion 14. The eye shields 176 are supported on the bottom platform panel 74. The user removes the eye shields 176 from the tower portion 12 through the opening 180. The tabs 178 help to retain the eye shields 176 within the tower portion 12 until removed by the user.

When the eye shields 176 are placed within the tower portion 12, the top back flap 38 and top front flap 54 are detached from the top lid panel 20 along cut lines 42 and 58. The top front and back flaps 38 and 54 are folded inward along fold lines 40 and 56, respectively. The top lid panel 20 is folded inward along fold line 22 over the top front and back flaps 38 and 54. Top lid panel 20 is folded along fold line 30 and the resulting flap 35 is tucked in to secure the top lid panel 20 to create top wall 190.

Figure 8:
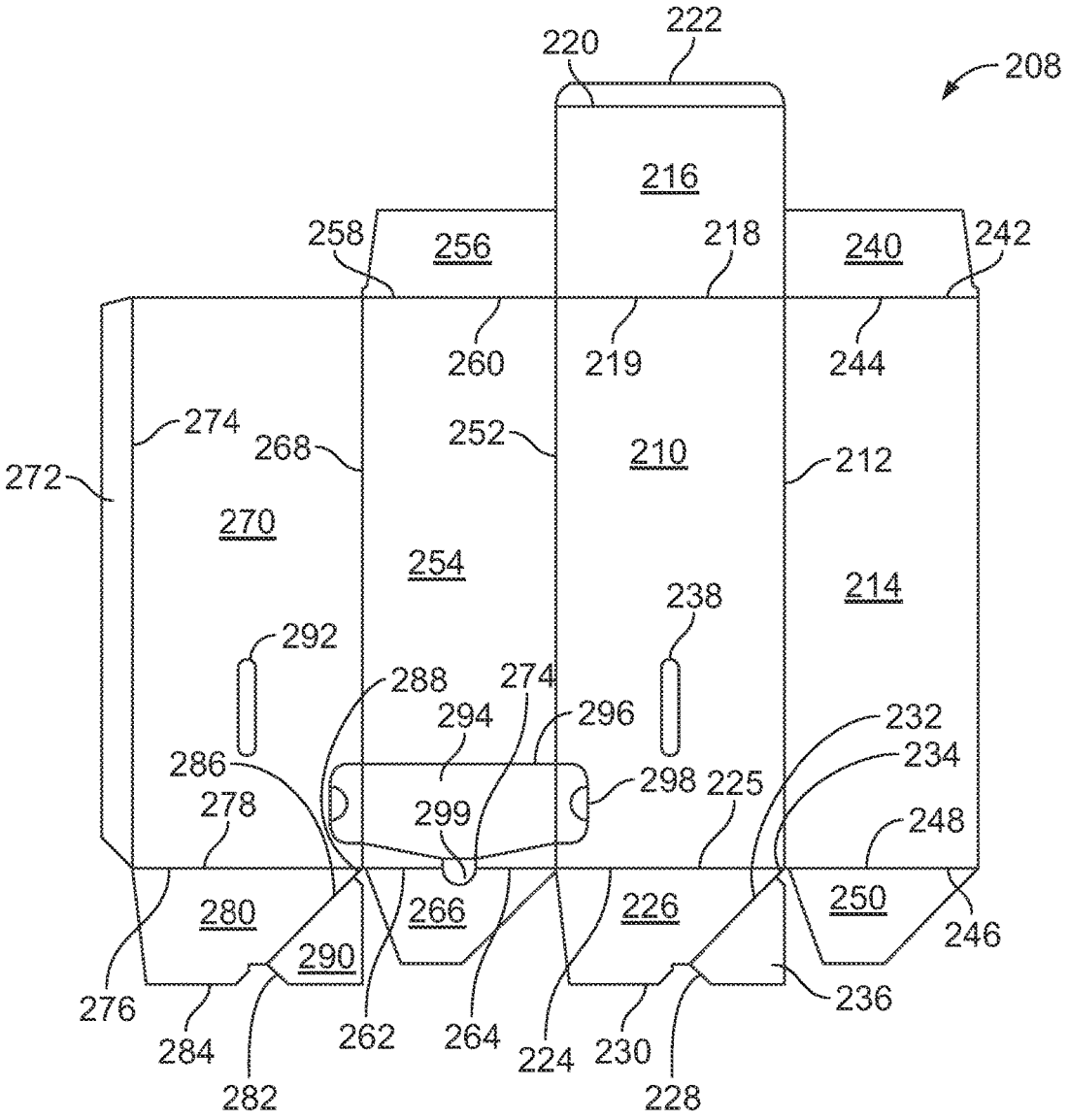
FIG. 8 is plan view of blank for a tower portion made in accord with an embodiment of the present invention.
Figure 9:
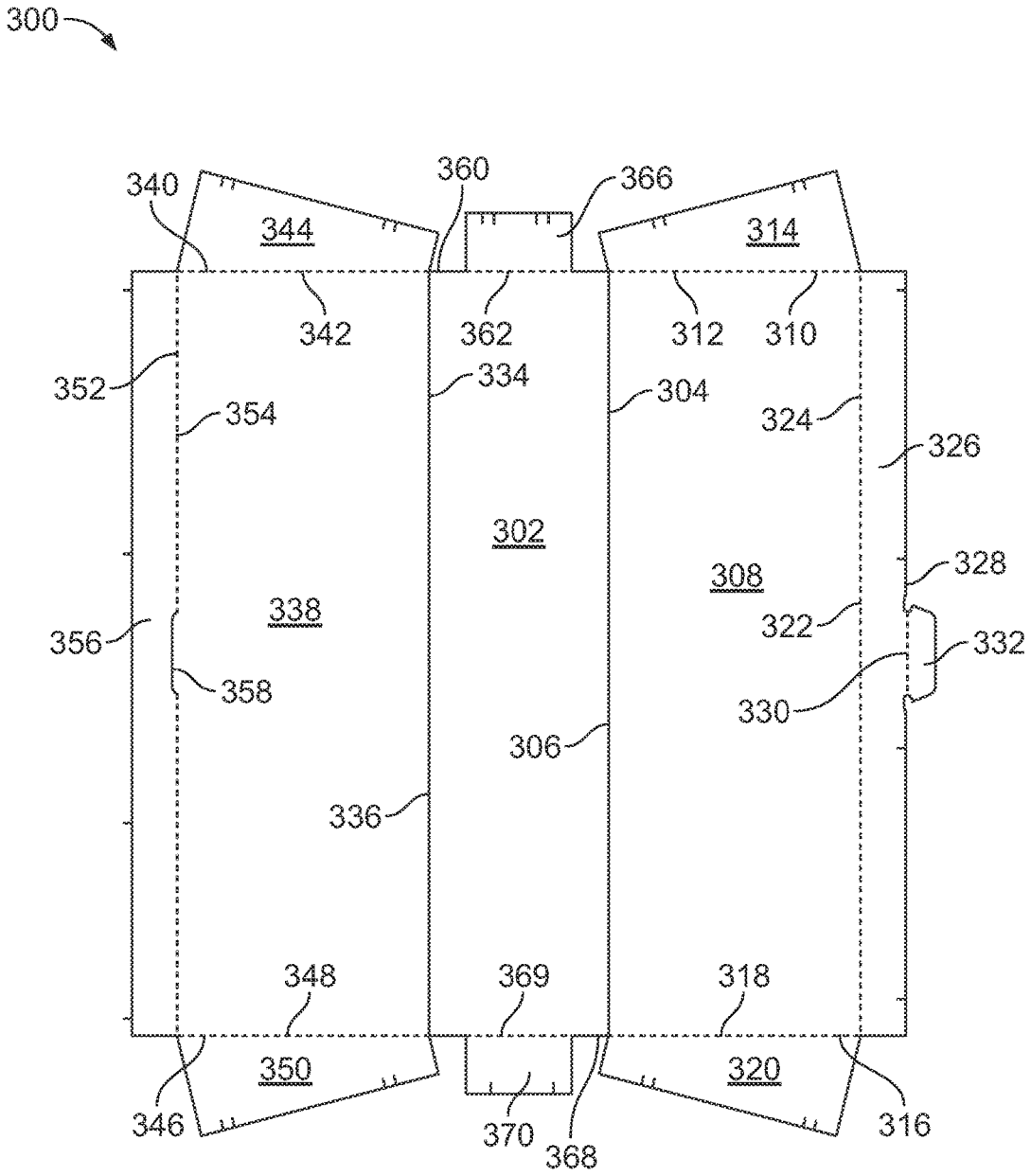
FIG. 9 is a plan view of blank for an insert portion made in accord with an embodiment of the present invention.

In another embodiment shown in FIGS. 8-9, the gravity fed eye shield dispenser 10 is made from a single blanks 208 and 300. FIG. 8 shows the blank 208 from which the tower portion 12 is assembled. The blank 208 includes a first side panel 210. Attached to the first side panel 210 along a first fold line 212 is a back panel 214. A top lid panel 216 is attached to a top edge 218 of the first side panel 210 along a second fold line 219. The top lid panel 216 includes a top lid fold line 220 near its free edge 222. Also attached to a bottom edge 224 of the first side panel 210 along a third fold line 225 is a first bottom panel 226. The first bottom panel 226 includes a first cutout portion 228 generally in the center of its free edge 230. The first bottom panel 226 has a diagonal fourth fold line 232 extending from the first cutout portion 228 generally toward a first corner 234. When folded the diagonal fourth fold line 232 creates a first tab 236. The first side panel 210 can include an oval or any suitable shaped opening 238 placed near the bottom edge 234.

The back panel 214 includes a top back flap 240 attached to a top edge 242 along a fifth fold line 244. Attached to a bottom edge 246 along a sixth fold line 248 is a generally trapezoidal bottom back flap 250.

Also attached to the first side panel 210 along a seventh fold line 252 is a front panel 254. The front panel 254 includes a top front flap 256 attached to a top edge 258 along an eighth fold line 260. Attached to a bottom edge 262 along a ninth fold line 264 is a generally trapezoidal bottom front flap 266.

Attached to the front panel 254 along a tenth fold line 268 is a second side panel 270. The second side panel 270 includes a glue flap 272 attached along an eleventh fold line 274. Also attached to a bottom edge 276 of the second side panel 270 along a twelfth fold line 278 is a second bottom panel 280. The second bottom panel 280 includes a second cutout portion 282 generally in the center of its free edge 284. The second bottom panel 280 has a diagonal thirteenth fold line 286 extending from the second cutout portion 282 generally toward a second corner 288. When folded the diagonal thirteenth fold line 286 creates a second tab 290. The second side panel 270 can include an oval or any suitable shaped opening 296 placed near the bottom edge 276. A detachable cutout 294 is located toward the bottom edge of the front panel 254. The cutout 294 is defined by perforated line 296. The cutout 294 extends partially into the first side panel 210 and a second side panel 270. The cutout 294 includes openings 298 on opposite sides of the cutout 294. The cutout 294 also includes a tab 299 that extends into the bottom front flap 266.

FIG. 9 shows an insert blank 300 to be erected into the insert 14 and inserted into the tower portion 12. The blank 300 includes a front panel 302. Attached to a first edge 304 of the front panel 302 along a first fold line 306 is a first wing panel 308. The first wing panel 308 is generally rectangular. Attached to a top edge 310 of the first wing panel 308 along a second fold line 312 is a first top flap 314. Attached to a bottom edge 316 of the first wing panel 308 along a third fold line 318 is a back bottom flap 320. Attached to a side edge 322 of the first wing panel 308 along a fourth fold line 324 is a first end flap 326. Along an outer edge 328 along a fifth fold line 330 of the first end flap 326 is a tab 332.

Attached to a second edge 334 of the front panel 302 along a sixth fold line 336 is a second wing panel 338. The second wing panel 338 is generally rectangular. Attached to a top edge 340 of the second wing panel 338 along a seventh fold line 342 is a second top flap 344. Attached to a bottom flap 346 of the second wing panel 308 along an eighth fold line 348 is a second bottom flap 350. Attached to a side edge 352 of the second wing panel 338 along a ninth fold line 354 is a second end flap 356. Along the ninth fold line 354 is a slot 358 to accommodate tab 330.

Attached to a top edge 360 of the front panel 302 along a tenth fold line 362 is a front top flap 366. Attached to a bottom edge 368 of the front panel 302 along an eleventh fold line 369 is a front bottom flap 370.

To assemble the dispenser 10 from the blanks 208 and 300, the tower portion 12 is erected. To erect the tower portion 12, the first side panel, back panel, front panel and second side panel are folded inward along fold lines 212, 252, and 268. The first and second bottom panels 226 and 280 are folded inward along fold lines 225, 248, 264 and 278 such that the cutouts 228 and 282 of the first and second bottom panels 226 and 280 engage. The front and back bottom flaps 250 and 266 are folded inward along fold lines 248 and 264. This forms the bottom of the tower portion 12. The glue flap 272 of the second side panel 270 is glued to the back panel 214. This forms the tower portion 12.

The insert 14 is assembled from blank 308 by folding the first and second wing portions 308 and 338 inwardly along fold lines 306 and 336 such that the tab 332 is inserted into slot 358. The first and second top flaps 314 and 344 and first second bottom flaps 320 and 350 are folded outwardly along fold lines 312, 342, 318, and 348. The top and bottom front flaps 366 are 370 are folded inwardly along fold lines 362 and 369. This forms the insert 14.

The insert 14 is then inserted into the tower portion 12. Eye shields or other items are inserted into the dispenser 10. The detachable cutout 294 is removed from tower portion 12 by inserting a finger into the openings 298 and pulling outwardly, such that an opening 180 is created. When the cutout 294 is removed, tab 299 created a scallop 374 extending into bottom front flap 370 to facilitate removal of eye shields from the dispenser 10. The dispenser 10 is closed by folding the top back and front flaps 240 and 256 inward along fold lines 244 and 260, and then folding the top lid 216 inward along fold line 219 over the top flaps 24 and 256 and tucking the top lid flap 216 using top lid fold line 220.

While the specific embodiments have been illustrated and described, numerous modifications come to mind without significantly departing from the spirit of the invention, and the scope of protection is only limited by the scope of the accompanying Claims.

What is claimed is:

1. A gravity fed dispenser comprising:

a tower portion including a front wall, a back wall, a top wall, a bottom wall, and a pair of side walls, wherein the tower portion is formed from a single blank of material;

an insert portion located within the tower portion, the insert portion including a front insert wall, and a first wing and a second wing attached to opposite edges of the front insert wall; and a detachable cutout being completely removable to leave an opening in a lower portion of the tower portion configured to dispense articles between the tower portion and the insert portion, wherein removal of the detachable cutout provides immediate access to inside the tower portion for dispensing articles, and further comprising eye shields inside the tower portion, wherein the eye shields are stacked inside the tower portion so that lens portions of the eye shields align between the front wall of the tower portion and the front insert wall of the insert portion.

2. The gravity fed dispenser of claim 1 wherein the tower portion single blank of material comprises:

a first side panel;

a top lid panel attached to a top edge of the first side panel along a first fold line, the top lid panel including a third fold line near a free edge on an opposite end from the first fold line;

a bottom lid panel attached to a bottom edge of the first side panel along a second fold line, the bottom lid panel including a fourth fold line near a free edge on an opposite end from the second fold line;

a back panel attached to a first edge of the first side panel along a fifth fold line;

a top back flap attached to a top edge of the back panel along a sixth fold line;

a bottom back flap attached to a bottom edge of the back panel along a seventh fold line;

a front panel attached to a second edge of the first side panel along an eighth fold line;

a top front flap attached to a top edge of the front panel along a ninth fold line;

a bottom front flap attached to a bottom edge of the front panel along a tenth fold line;

the detachable cutout located toward the bottom edge of the front panel;

a second side panel attached to an edge of the front panel along an eleventh fold line;

a bottom platform panel attached to a bottom edge of the second side panel along a twelfth fold line, the bottom platform panel including side flaps attached along thirteenth and fourteenth fold lines, and a front flap attached along a fifteenth fold line, the bottom platform panel also including an attachment panel formed between the twelfth fold line and a sixteenth fold line; and a glue panel attached to an edge of the second side panel along a seventeenth fold line.

3. The gravity fed dispenser of claim 1 wherein the insert portion is formed from a single blank of material.

4. The gravity fed dispenser of claim 3 wherein the single blank of material comprises:

a front panel;

a first side panel attached to a first side edge of the front panel along a first fold line;

a first wing panel attached to a side edge of the first side panel along a second fold line;

a first top tab attached to a top edge of the first side panel along a third fold line;

a first bottom tab attached to a bottom edge of the first side panel along a fourth fold line;

a second side panel attached to a second side edge of the front panel along a fifth fold line;

a second wing panel attached to a side edge of the second side panel along a sixth fold line;

a second top tab attached to a top edge of the second side panel along a seventh fold line;

a second bottom tab attached to a bottom edge of the second side panel along an eighth fold line;

a top end panel attached to a top edge of the front panel along a ninth fold line, the top end panel including first and second wings attached thereto along eleventh and twelfth fold lines, eleventh and twelfth fold lines each including a slot along its length; and a bottom end panel attached to a bottom edge of the front panel along a tenth fold line, the bottom end panel including third and fourth wings attached thereto along thirteenth and fourteenth fold lines, thirteenth and fourteenth fold lines each including a slot along its length.

5. The gravity fed dispenser of claim 4 wherein the top end panel and bottom end panel are trapezoidal shaped and tapered inward from the top edge of the front panel.

6. An eyewear dispenser comprising:

a tower portion including a front wall, a back wall, a top wall, a bottom wall, and a pair of side walls;

an insert portion located within the tower portion, the insert portion including a front insert wall, and a first wing and a second wing in communication with opposite edges of the front insert wall; and a detachable cutout being completely removable to leave an opening at an upper or lower portion of the tower portion configured to dispense articles between the tower portion and the insert portion;

wherein the tower portion and the insert portion are each formed from single blanks of material, and wherein removal of the detachable cutout provides immediate access to inside the tower portion for dispensing articles, and further comprising eye shields inside the tower portion, wherein the eye shields are stacked inside the tower portion so that lens portions of the eye shields align between the front wall of the tower portion and the front insert wall of the insert portion.

7. The dispenser of claim 6 wherein the tower portion blank includes:

a first side panel;

a back panel attached to the first side panel along a first fold line;

a top lid panel attached to a top edge of the first side panel along a second fold line;

a first bottom panel attached to a bottom edge of the first side panel along a third fold line;

a top back flap attached to a top edge of the back panel long a fifth fold line;

a bottom back flap attached to a bottom edge of the back panel along a sixth fold;

a front panel attached to the first side panel along a seventh fold line;

a top front flap attached to a top edge of the front panel along an eighth fold line;

a bottom front flap attached to a bottom edge of the front panel along a ninth fold line;

a second side panel attached to the front panel along a tenth fold line;

a glue flap attached to the second side panel along an eleventh fold line;

a second bottom panel attached to a bottom edge of the second side panel along a twelfth fold line; and the detachable cutout located near the bottom edge of the front panel, the cutout defined by a perforated line, and wherein eyewear is gravity fed in a direction from the top wall to the bottom wall, and the opening left by the detachable cutout allows for eyewear to be dispensed.

8. The dispenser of claim 7 wherein the top lid panel includes a top lid fold line near a free edge.

9. The dispenser of claim 7 wherein the first bottom panel includes a first cutout portion generally in the center of a free edge, and the second bottom panel includes a second cutout portion generally in the center of a free edge.

10. The dispenser of claim 9 wherein the first bottom panel has a diagonal fourth fold line extending from the first cutout portion generally toward a first corner, creating a first tab, and the second bottom panel has a diagonal thirteenth fold line extending from the second cutout portion generally toward a second corner, creating a second tab.

11. The dispenser of claim 7 wherein the first and second side panels include an opening near their bottom edges.

12. The dispenser of claim 7 wherein the cutout extends partially into the first side panel and a second side panel.

13. The dispenser of claim 7 wherein the cutout includes openings on opposite sides, and a tab extending into the bottom front flap.

14. The dispenser of claim 6 wherein the insert blank includes:

a front panel providing the front insert wall;

a first wing panel attached to a first edge of the front panel along a first fold line;

a first top flap attached to a top edge of the first wing panel along a second fold line;

a back bottom flap attached to a bottom edge of the first wing panel along a third fold line;

a first end flap attached to a side edge of the first wing panel along a fourth fold line;

a tab located along an outer edge of the first end flap;

a second wing panel attached to a second edge of the front panel along a sixth fold line;

a second top flap attached to a top edge of the second wing panel along a seventh fold line;

a second bottom flap attached to a bottom edge of the second wing panel along an eighth fold line;

a second end flap attached to a side edge of the second wing panel along a ninth fold line;

a slot located along the ninth fold line to accommodate the tab;

a front top flap attached to a top edge of the front panel along a tenth fold line; and a front bottom flap attached to a bottom edge of the front panel along an eleventh fold line.

15. The dispenser of claim 6, wherein removal of the detachable cutout allows dispensing of articles without movement of the insert portion.

16. The dispenser of claim 6, wherein the insert portion is stationary with respect to the tower portion between a first state in which the detachable cutout is attached to the tower portion to completely enclose the articles in the tower portion and a second state in which the detachable cutout is completely removed from the tower portion for dispensing articles.

17. The dispenser of claim 6, wherein the dispenser is configured to dispense articles through the opening with the insert portion being completely enclosed by the tower portion.

18. The dispenser of claim 6, wherein the eye shields are stacked inside the tower portion so that earpieces of the eye shields are disposed along the first and second wings of the insert portion.

19. The dispenser of claim 6, wherein the dispenser is gravity fed, and wherein the detachable cutout is completely removable to leave an opening in the lower portion of the tower portion.

20. A gravity fed dispenser comprising:

a tower portion including a front wall, a back wall, a top wall, a bottom wall, and a pair of side walls;

an insert portion located within the tower portion, the insert portion including a front insert wall, and a first wing and a second wing attached to opposite edges of the front insert wall; and an opening in a lower portion of the tower portion;

wherein the insert portion is formed from a single blank of material, the single blank of material including:

a front panel;

a first side panel attached to a first side edge of the front panel along a first fold line;

a first wing panel attached to a side edge of the first side panel along a second fold line;

a first top tab attached to a top edge of the first side panel along a third fold line;

a first bottom tab attached to a bottom edge of the first side panel along a fourth fold line;

a second side panel attached to a second side edge of the front panel along a fifth fold line;

a second wing panel attached to a side edge of the second side panel along a sixth fold line;

a second top tab attached to a top edge of the second side panel along a seventh fold line;

a second bottom tab attached to a bottom edge of the second side panel along an eighth fold line;

a top end panel attached to a top edge of the front panel along a ninth fold line, the top end panel including first and second wings attached thereto along eleventh and twelfth fold lines, eleventh and twelfth fold lines each including a slot along its length; and a bottom end panel attached to a bottom edge of the front panel along a tenth fold line, the bottom end panel including third and fourth wings attached thereto along thirteenth and fourteenth fold lines, thirteenth and fourteenth fold lines each including a slot along its length.

21. The gravity fed dispenser of claim 20 wherein the top end panel and bottom end panel are trapezoidal shaped and tapered inward from the top edge of the front panel.

22. A gravity fed dispenser comprising:

a tower portion including a front wall, a back wall, a top wall, a bottom wall, and a pair of side walls;

an insert portion located within the tower portion, the insert portion including a front insert wall, and a first wing and a second wing attached to opposite edges of the front insert wall;

an opening in a lower portion of the tower portion;

the tower portion and insert portion each formed from a single blank of material, wherein the tower portion blank includes:

a first side panel;

a back panel attached to the first side panel along a first fold line;

a top lid panel attached to a top edge of the first side panel along a second fold line;

a first bottom panel attached to a bottom edge of the first side panel along a third fold line;

a top back flap attached to a top edge of the back panel along a fifth fold line;

a bottom back flap attached to a bottom edge of the back panel along a sixth fold:

a front panel attached to the first side panel along a seventh fold line;

a top front flap attached to a top edge of the front panel along an eighth fold line;

a bottom front flap attached to a bottom edge of the front panel along a ninth fold line;

a second side panel attached to the front panel along a tenth fold line;

a glue flap attached to the second side panel along an eleventh fold line;

a second bottom panel attached to a bottom edge of the second side panel along a twelfth fold line; and a detachable cutout located near the bottom edge of the front panel, the cutout defined by a perforated line;

wherein the cutout includes openings on opposite sides, and a tab extending into the bottom front flap.

23. A gravity fed dispenser comprising:

a tower portion including a front wall, a back wall, a top wall, a bottom wall, and a pair of side walls;

an insert portion located within the tower portion, the insert portion including a front insert wall, and a first wing and a second wing attached to opposite edges of the front insert wall;

an opening in a lower portion of the tower portion;

the tower portion and insert portion each formed from a single blank of material, wherein the insert blank includes:

a front panel;

a first wing panel attached to a first edge of the front panel along a first fold line;

a first top flap attached to a top edge of the first wing panel along a second fold line;

a back bottom flap attached to a bottom edge of the first wing panel along a third fold line;

a first end flap attached to a side edge of the first wing panel along a fourth fold line;

a tab located along an outer edge of the first end flap;

a second wing panel attached to a second edge of the front panel along a sixth fold line;

a second top flap attached to a top edge of the second wing panel along a seventh fold line;

a second bottom flap attached to a bottom edge of the second wing panel along an eighth fold line;

a second end flap attached to a side edge of the second wing panel along a ninth fold line;

a slot located along the ninth fold line to accommodate the tab;

a front top flap attached to a top edge of the front panel along a tenth fold line; and a front bottom flap attached to a bottom edge of the front panel along an eleventh fold line.

24. An eyewear dispenser comprising:

a tower portion including a front wall, a back wall, a top wall, a bottom wall, and a pair of side walls, wherein the tower portion is formed from a single blank of material;

an insert portion located within the tower portion, the insert portion including a front insert wall and a pair of side walls attached to opposite edges of the front insert wall;

a plurality of eye shields inside the tower portion; and a detachable cutout being completely removable to leave an opening at an upper or lower portion of the tower portion, the opening being configured to dispense eye shields held between the tower portion and the insert portion, wherein removal of the detachable cutout provides immediate access to inside the tower portion for dispensing eye shields, and wherein the eye shields are stacked inside the tower portion so that lens portions of the eye shields align between the front wall of the tower portion and the front insert wall of the insert portion.

25. The dispenser of claim 24, wherein each side wall of the insert portion comprises a side panel and a wing panel.

26. The dispenser of claim 24, wherein the insert portion is formed from a single blank of material.

* * * * *